US005713821A

United States Patent [19]

Nissen

[11] Patent Number: 5,713,821

[45] Date of Patent: Feb. 3, 1998

[54] PORTABLE EXERCISE DEVICE

[76] Inventor: George Nissen, 5123 D Renaissance Ave., San Diego, Calif. 92122

[21] Appl. No.: 695,194

[22] Filed: Aug. 7, 1996

[51] Int. Cl.[6] ..... A63B 21/015

[52] U.S. Cl. ..... 482/114; 482/124; 482/126; 482/131; 482/139; 482/115

[58] Field of Search ..... 482/114, 115, 482/121, 122, 124, 125, 126, 131, 129, 130, 139

[56] References Cited

U.S. PATENT DOCUMENTS

| | | | |
|---|---|---|---|
| 2,183,265 | 12/1939 | Maloney . | |
| 3,081,645 | 3/1963 | Bergfors . | |
| 3,789,696 | 2/1974 | Beam, III . | |
| 3,999,752 | 12/1976 | Kupperman et al. | 482/131 |
| 4,372,553 | 2/1983 | Hatfield | 482/133 |
| 4,549,534 | 10/1985 | Zagorski et al. . | |
| 4,549,555 | 10/1985 | Fraser et al. . | |
| 4,915,374 | 4/1990 | Watkins . | |
| 5,116,296 | 5/1992 | Watkins et al. . | |
| 5,141,482 | 8/1992 | Hern | 482/129 |
| 5,234,394 | 8/1993 | Wilkinson | 482/129 |
| 5,399,139 | 3/1995 | Malynowsky | 482/129 |

*Primary Examiner*—Lynne A. Reichard
*Attorney, Agent, or Firm*—Nydegger & Associates

[57] ABSTRACT

A portable exercise device for use by a human in a seated position in a seat is provided herein. The exercise device includes a pair of grips, a flexible member interconnecting the grips, a pivot and a connector. Each of the grips is suitable for interacting with a human hand or foot. The pivot, i.e., a roller contacts the flexible member and allows for movement of flexible member over the pivot. The connector retains the pivot proximate the human while the human is in the seated position. The connector is typically attached to a seatbelt and exercise device functions somewhat similar to a stationary cycle. Alternately, the connector is attached to one of the feet of the human and the exercise device is useful for exercising the upper body of the human. A tubular housing can be used for positioning the pivot above the seat and storing the grips, flexible member, pivot and connector when the exercise device is not in use.

16 Claims, 2 Drawing Sheets

PORTABLE EXERCISE DEVICE

FIELD OF THE INVENTION

The present invention relates a portable exercise device which is particularly, but not exclusively useful for exercising while in a seat such as an airplane seat, a vehicle seat, a train seat, a wheelchair or a chair.

BACKGROUND

It has long been known that regular exercise is one of the cornerstones for maintaining good health and weight control. However, a majority of humans are simply not getting enough exercise.

As technology progresses, humans, on average, are spending more time behind the desk, at a computer terminal or traveling in a vehicle, airplane or a train. Accordingly, the problem of not sufficient amount of exercise is getting worse. Further, these humans are restricting the circulation of blood through their legs and feet during this time in a chair.

Common excuses for not exercising include, lack of time to exercise, the existence of physical limitations which make the use of exercise equipment difficult, the lack of financial resources to join a gym and/or the lack of financial resources to purchase exercise equipment for the home.

Presently, a wide variety of exercise equipment is available for use at a gym or at home. However, the existing exercise equipment is relatively large and heavy. Further, the existing equipment requires a lot of space to use and store. Thus, the existing equipment is not readily portable and cannot be easily used in confined areas such as an airplane seat, train seat, vehicle seat or chair. This is especially true when the user is required to be restrained by a seat belt.

Additionally, people with physical limitations, such as being confined to a wheelchair, are simply unable to effectively use most existing equipment. Further, the existing equipment can be difficult to use, difficult to understand, and difficult to setup for use.

It is therefore an object of the present invention to provide an exercise device which is easily used in a confined area such as an airplane seat, a train seat, a vehicle seat or a chair without interfering with the performance of the seat belt. Another object of the present invention is to provide an exercise device that can be used with the seat belt on the airplane with the tray table of the airplane seat in the down position. An additional object of the present invention is to provide an exercise device which can be used by humans confined to wheel chairs. Another object of the present invention is to provide an exercise device which is relatively small, lightweight and readily portable. Another object of the present invention is to provide an exercise device which is easy to use and easy to understand. Yet another object of the present invention is to provide an exercise device which is relatively inexpensive to manufacture and maintain.

SUMMARY

The present invention is directed to an exercise device which satisfies these objectives. An exercise device for use by a human while in a seated position, having features of the present invention, includes a pair of grips, at least one flexible member interconnecting the grips, a pivot and a connector.

As detailed below, the exercise device simulates a stationary cycle or an upper body exercise machine and can be used in a confined area such as an airplane seat, a train seat, a vehicle seat or a chair utilizing a seat belt and without interfering with the effectiveness of the seat belt. Additionally, the exercise device is small, lightweight and easy to operate.

Each grip is sized and shaped for selectively interacting with a human hand or foot. When the exercise device is used as a stationary bike, each grip interacts with the foot. Alternatively, when the exercise device is used as an upper body machine, each grip interacts and is retained with the hand.

The pivot contacts the flexible member between the grips and allows for movement of the flexible member over the pivot. Typically, the pivot is a roller which selectively rotates on a roller pin in a first direction and an opposite second direction. Since the grips are attached to the flexible member, the pivot allows for movement of the grips at substantially the same rate relative to the pivot, in substantially opposite directions relative to the pivot.

The connector retains the pivot proximate the human while the human is in the seated position. Typically, the connector retains the pivot proximate the legs of the human in the seated position. More precisely, the connector retains the pivot substantially between the legs or knees of the human in the seated position.

Depending on how the exercise device is utilized, the connector can be selectively attached to a seat attachment such as a seat belt or one of the user's feet. For example, to simulate a stationary cycle, the connector is secured to the seat belt and one of the human's feet is placed in each grip. Alternately, for example, to simulate an upper body machine, the connector is secured to one of the human's feet and one of the human's hands retains each grip.

The exercise device can include a housing disposed between the seat and the connector or the pivot to hold the pivot away from the seat for use as a stationary cycle. Preferably, the housing includes a substantially tubular wall that defines an internal cavity having a sufficient volume to enclose the grips, flexible member, pivot and connector therein. In this embodiment, the exercise device can be transported and stored in the housing.

It is important to recognize that an exercise device, in accordance with the present invention, can be easily used in a confined area, such as an airplane seat, without interfering with the seat belt and with the tray table in the down position. Further, the exercise device is relatively small, lightweight and portable. Also, the exercise device is easy to understand, easy to use, and relatively inexpensive to manufacture and maintain.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figures 1, 2:
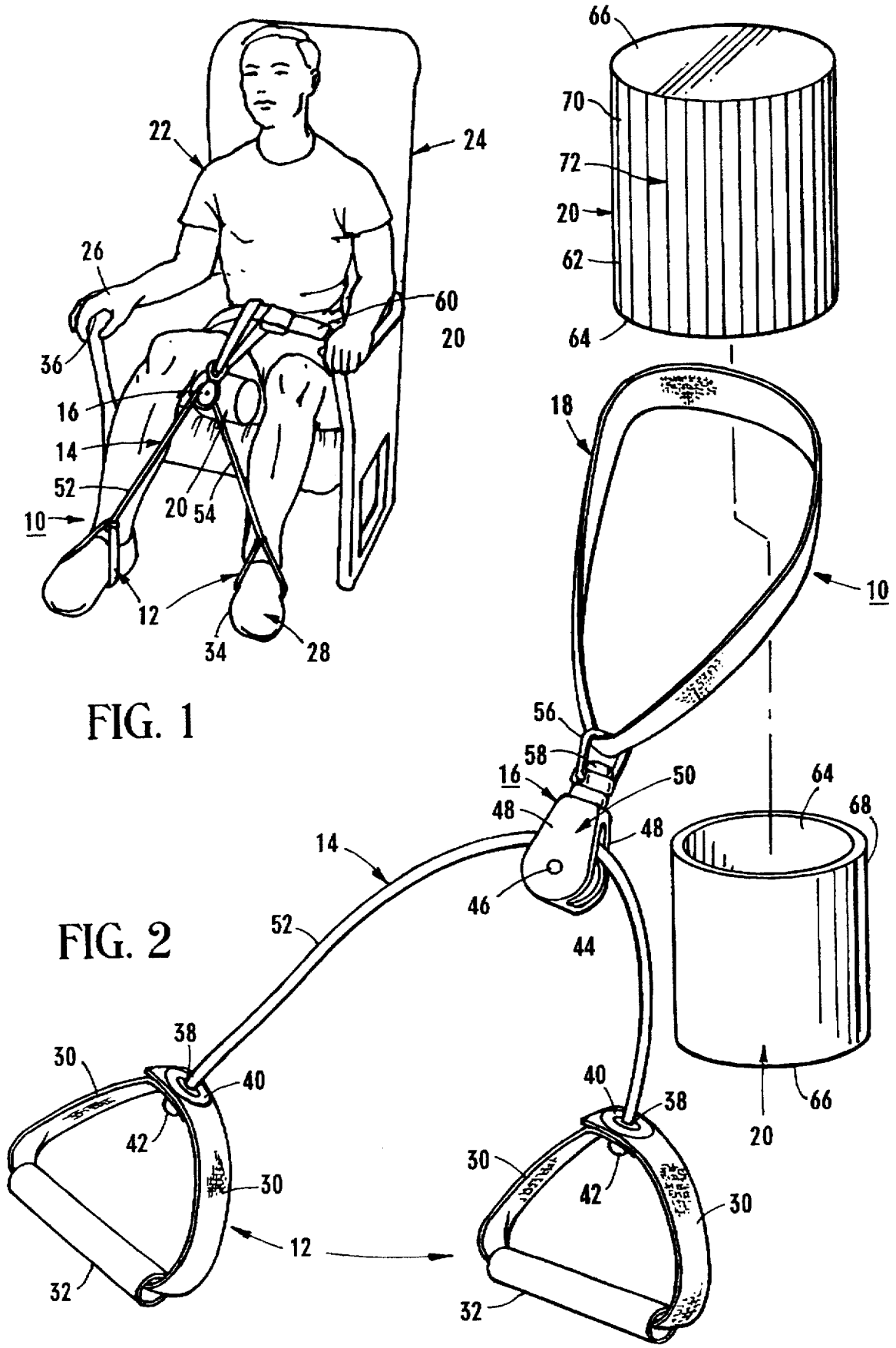
FIG. 1 is a perspective view of a human in a seated position utilizing an exercise device having features of the present invention.
FIG. 2 is a perspective view of the exercise device of FIG. 1.
Figure 3:
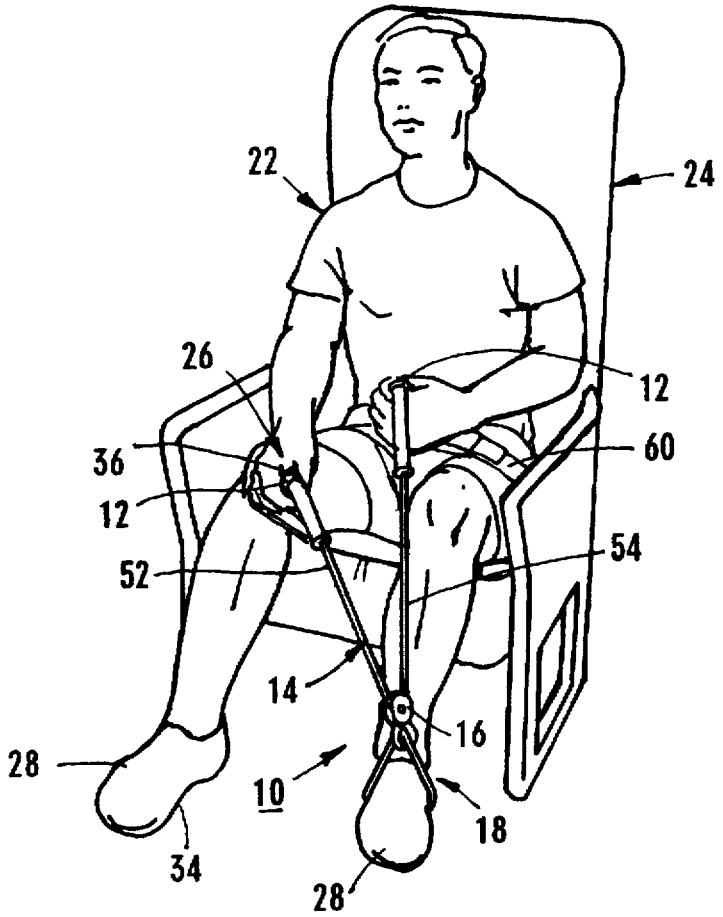
FIG. 3 is a perspective view of the human in a seated position utilizing the exercise device of FIG. 1 for an upper body workout.

Referring initially to FIGS. 1–3, an exercise device 10 according to the present invention includes (i) a pair of grips 12, (ii) a flexible member 14, (iii) a pivot 16, (iv) connector 18 and (v) a housing 20.

As described below, the exercise device 10 is particularly useful for exercising by a human 22 while in a seated position to improve the circulation of blood through the body. Accordingly, the exercise device 10 is adaptable for use while sitting in almost any seat 24 including, for example an airplane seat, an automobile seat, a train seat, a wheelchair, a chair at a desk, a chair at a computer terminal, or a recliner.

Each grip 12 is sized and shaped for selectively interacting with a human hand 26 or foot 28. As shown in the figures, each grip 12 can have an open, substantially triangular shape with a pair of sides 30 and a crossbeam 32 for interacting with a bottom 34 of the foot 28 or a palm 36 of the hand 26. In the embodiment shown in the figures, the sides 30 and crossbeam 32 are each about three inches long.

Preferably, each grip 12 is made of a lightweight, flexible material so that the exercise device is lightweight and compacts to a relatively small size. For example, each grip 12 can be a flexible, strap having opposed ends which are secured together via sewing, snaps, rivets, or some other way known by those in the art. An acceptable strap is made from nylon and is about one inch wide and about one-eighth (⅛) of an inch thick. The crossbeam 32 can be a piece of flexible rubber tubing which encircles a portion of the strap. An acceptable rubber tubing is about one-half (½) inch in diameter and has a thickness of about one-eighth (⅛) of an inch.

A grip aperture 38 can extend through each grip 12 for attaching each grip 12 to the flexible member 14. A metallic grip ring 40 can be disposed around the grip aperture 38 to protect the strap.

The flexible member 14 interconnects each of the grips 12. The flexible member 14 can be a cord, cable, strap, rope, or wire or an equivalent flexible structure.

In the embodiment shown in the figures, the flexible member 14 is a cord which extends through the grip ring 40 in each grip 12. A grip retainer 42 encircles the cord and retains each grip 12 to the flexible member 14. The grip retainer 42 can be a metal ring compression fitted onto the flexible member 14 or some other equivalent structure known by those skilled in the art. Alternately, the flexible member 14 could be two separate flexible members (not shown) which wrap around the pivot 16 in opposite directions.

The flexible member 14 shown in the Figures is about one-quarter of an inch in diameter and about fifteen inches long. However, the length of the flexible member 14 may need to increase or decrease to suit the height of the particular users. Thus, in another version of the present invention, the length of the flexible member 14 may be adjustable.

The pivot 16 contacts the flexible member 14 between the grips 12 and allows for the movement of the flexible member 14 over the pivot 16. In the embodiment shown in the Figures, the pivot 16 is a grooved roller 44 or pulley which rotates on a roller pin 46 that is attached to opposed arms 48 of a pulley assembly 50. The roller 44 is substantially free to selectively rotate in a first, counterclockwise direction or second, clockwise direction around the roller pin 46. A tightener (not shown) can be added which selectively inhibits the rotation of the roller 44.

Basically, the roller 44 divides the flexible member 14 into a first flexible section 52 and a second flexible section 54. The first flexible section 52 becomes longer and the second flexible section 54 becomes shorter as the roller 44 rotates in the first direction and the first flexible section 52 becomes shorter and the second flexible section 54 becomes longer as the roller 44 rotates in the second direction. Thus, the roller 44 allows for movement of the grips 12 at substantially the same rate relative to the roller 44, in substantially opposite directions.

The pulley assembly 50 can include a pulley ring 56 for attaching the pulley assembly 50 to the connector 18. Preferably, a swivel connector 58 connects the pulley ring 56 to the opposed arms 48 and allows for relative rotation between the pulley ring 56 and the opposed arms 48 so that the exercise device 10 operates freely.

The connector 18 retains the pivot 16 proximate the human 22 while the human 22 is in the seated position. Typically, the connector 18 retains the pivot 16 proximate the legs. More specifically, the connector 18 retains the pivot 16 approximately between the legs or knees of the human 22 while the human 22 is in the seated position.

As shown in the FIGS. 1 and 3, the connector 18 can be secured to a seat attachment 60, i.e., a seat belt of the seat 24, or the foot 28. Alternately, for seats 24 without seat belts, the connector 18 can be secured to a belt (not shown) which encircles the human or a seat attachment 60 which is an integral part of the seat 24. Also, a hook (not shown) can be added to a wheelchair (not shown) to facilitate the use of the present exercise device 10 by the physically challenged.

Preferably, the connector 18 selectively retains the pivot 16 so that the exercise device 10 can be easily attached and detached to the seat attachment 60.

The connector 18 is preferably made of a lightweight, flexible material so that the exercise device 10 is lightweight and compacts to a relatively small size. The connector 18 can be a strap, cord, cable, rope, wire or an equivalent structure. For example, in the embodiment shown in the FIG. 2, the connector 18 is a flexible, nylon strap which extends through the pulley ring 56. The strap has opposed ends which are secured together via sewing, snaps, or some other way know by those in the art. An acceptable strap is about sixteen (16) inches long, one (1) inch wide and about one-eighth (⅛) of an inch thick.

The length of the connector 18 can vary according to the height and size of the human 22. Thus, in another version of the present invention, the length of the connector can be selectively adjustable 10 to different lengths.

The housing 20 stores and protects the grips 12, flexible member 14, pivot 16 and connector 18 during transport. The housing 20 includes a substantially tubular wall 62 which defines an internal cavity 64 having a sufficient volume to enclose the grips 12, flexible member 14, pulley 16 and connector 18 therein. The housing 20 can also include opposed ends 66 which selectively enclose the tubular wall 62.

The housing 20 can be designed in a number of alternate ways. For example, as shown in FIG. 2, the housing can comprise an inner canister 68 and an outer canister 70 which fits over the inner canister 68. The inner and outer canisters 68, 70 are detachable and fit together to enclose the grips 12, flexible member 14, pivot 16 and connector 18.

The shape and size of the housing 20 can vary. In the embodiment shown in the Figures, the housing 20 is plastic and has a tubular, circular cross-section. The housing 20 has an outer diameter of about four and one-half (4.5) inches, a wall thickness of about one-sixteenth (1/16) of an inch and a width of about three and one-half (3.5) inches.

Additionally, referring to FIG. 1, the housing 20 can be disposed between the seat 24 and the connector 18 or pivot 16 to hold the pivot 16 away from the seat 24 during use of the exercise device 10 as a stationary cycle. Preferably, an outer surface 72 of the housing 20 is sufficiently rough to maintain the positioning of the housing 20 between the seat 24 and connector 18 or pivot 16 during usage.

OPERATION

An example of the operation of an exercise device 10 having features of the present invention can best be visualized with reference to the Figures. The operation of the exercise device 10 beings with the grips 12, flexible member 14, pulley assembly 50 and connector 18 being stored in the housing 20 for transporting the exercise device 10.

First, the human 22 sits in the seat 24. Next, referring to FIG. 2, the exercise device 10 is removed from the housing 20. For use as a stationary bike, the connector 18 is secured around the seat attachment 60, i.e., the seat belt and each foot 28 is placed in one of the grips 12. Subsequently, the housing 20 is placed between the pulley assembly 50 and the seat 24 so that the pulley assembly 50 is substantially between the legs approximate the knees. Now the exercise device 10 is ready for use. The human 22 can move his/her feet 28 in a circular bicycle motion, i.e., in the clockwise or counterclockwise direction. Alternately, the human 22 can simply move his/her feet 28 up and down. Since the flexible member 14 interconnects the grips 12, the amount of force necessary to move the grips 12 can be controlled by the legs. Above all, the functionality and integrity of the seat belt is not compromised by the exercise device 10.

Alternately, referring to FIG. 3, the exercise device 10 can be used for an upper body workout. In this setup, the connector 18 encircles one of the human's feet 28 and one of the grips 12 is placed in each hand 26 to exercise the upper body. In this position the arms can move up and down or in a circular pattern. Again, the functionality and integrity of the seat belt is not compromised by the exercise device 10.

Upon completion of exercising, the grips 12, flexible member 14, pivot 16 and connector 18 can be compacted to fit into the housing 20 for easy transport.

As is apparent for the operation of the exercise device 10, the exercise device can be used in a confined area, without interfering with the effectiveness of the seat belt. Further, the exercise device 10 is small, lightweight, readily portable, easy to operate and inexpensive to manufacture and maintain.

While the particular exercise device 10 as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. An exercise device for use by a human while in a seated position, the exercise device comprising:

a) a pair of grips, each grip adapted for selectively interacting with a human hand or foot;

b) at least one flexible member interconnecting the pair of grips;

c) a pivot contacting the flexible member between the grips and allowing for movement of the flexible member over the pivot;

d) a connector adapted for retaining the pivot proximate the human; and e) a seat adapted for use by the human, the seat including a seat attachment;

wherein, the connector selectively secures the pivot to the seat attachment.

2. The exercise device of claim 1 wherein the connector is adapted for retaining the pivot proximate the legs of the human.

3. The exercise device of claim 1 wherein the seat attachment is adapted for selectively retaining the human to the seat.

4. The exercise device of claim 1 wherein, the seat attachment is a seat belt adapted for substantially encircling a portion of a waist of the human.

5. The exercise device of claim 1 wherein the pivot allows for movement of the grips at substantially the same rate relative to the pivot, in substantially opposite directions relative to the pivot.

6. The exercise device of claim 1 wherein pivot includes a roller which selectively rotates around a roller pin in a first direction and an opposite second direction.

7. The exercise device of claim 6 wherein the roller separates the flexible member into a first flexible section and a second flexible section, the first flexible section becomes longer and the second flexible section becomes shorter as the roller rotates in the first direction and the first flexible section becomes shorter and the second flexible section becomes longer as the roller rotates in the second direction.

8. The device of claim 1 wherein each grip comprises a flexible strap and a flexible piece of tube which encircles a portion of the flexible strap.

9. An exercise device for use by a human while in a seated position, the exercise device comprising:

a) a pair of grips adapted for selectively interacting with a human hand or foot;

b) a flexible member interconnecting the pair of grips;

c) a roller assembly including a roller contacting the flexible member between the grips and allowing for movement of the flexible member over the roller;

d) a connector adapted for retaining the roller assembly proximate the human, the connector including a belt adapted for substantially encircling a portion of the human; and e) a seat adapted for use by the human, the seat including a seat attachment adapted for selectively retaining the human to the seat.

10. The exercise device of claim 9 wherein the seat attachment is a seat belt which is adapted for substantially encircles a portion of a waist of the human.

11. A exercise device that is adapted for use by a human in a seat, the exercise device comprising:

a) a pair of grips, each grip comprising a flexible strap and a flexible piece of tube which encircles a portion of the strap to form a surface adapted for selectively interacting with a human hand or foot;

b) a flexible member interconnecting the pair of grips;

c) a roller assembly including: (i) at least one roller arm; (ii) a roller attached to the roller arm with a roller pin which allows the roller to rotate relative to the roller arm, the roller contacting the flexible member between the grips and allowing for movement of the flexible member; (iii) a roller ring; and (iv) a swivel connector allowing for relative rotational movement between the roller arm and the roller ring;

d) a flexible connector adapted for selectively retaining at least a portion of the roller assembly proximate the human; and e) a housing adapted for being positioned between the seat and the connector to position the roller assembly away from the seat.

12. The exercise device of claim 11 wherein the housing including a substantially tubular wall which defines an internal cavity having a sufficient volume to enclose the grips, flexible member, roller assembly and connector therein.

13. An exercise device for use by a human while in a seat, the exercise device comprising:

a) a pair of grips, each grip adapted for selectively interacting with a human hand or foot;

b) at least one flexible member interconnecting the pair of grips;

c) a pivot contacting the flexible member between the grips and allowing for movement of the flexible member over the pivot;

d) a connector for retaining the pivot proximate the human; and e) a housing adapted for positioning between the seat and the connector to retain the pivot away from the seat.

14. The exercise device of claim 13 wherein the housing includes a substantially tubular wall which defines an internal cavity having a sufficient volume to enclose the grips, flexible member, pulley and connector therein.

15. An exercise device for use by a human while in a seated position, the exercise device is adapted for use with a seat having a seat attachment, the exercise device comprising:

a) a pair of grips for selectively interacting with a human hand or foot;

b) a flexible member interconnecting the pair of grips;

c) a roller assembly including a roller contacting the flexible member between the grips and allowing for movement of the flexible member over the roller;

d) a connector adapted for selective attachment to the seat attachment, the connector being adapted for retaining the roller assembly proximate the human; and e) a housing adapted for positioning between the seat and the connector to position the roller assembly away from the seat.

16. The exercise device of claim 15 wherein the housing includes a substantially tubular wall which defines an internal cavity having a sufficient volume to enclose the grips, flexible member, roller assembly and connector therein.

* * * * *